US006962280B2

(12) United States Patent
Kaya

(10) Patent No.: US 6,962,280 B2
(45) Date of Patent: Nov. 8, 2005

(54) ROTARY STITCHING DEVICE

(75) Inventor: Mehmet Oktay Kaya, Lee, NH (US)

(73) Assignee: Goss International Americas, Inc., Dover, NH (US)

( * ) Notice: Subject to any disclaimer, the term of this patent is extended or adjusted under 35 U.S.C. 154(b) by 307 days.

(21) Appl. No.: 10/190,320

(22) Filed: Jul. 5, 2002

(65) Prior Publication Data

US 2004/0004103 A1 Jan. 8, 2004

(51) Int. Cl.[7] ..... B27F 7/21
(52) U.S. Cl. ..... 227/81; 227/100; 227/117
(58) Field of Search ..... 227/81, 88, 100, 227/155, 85, 86, 117; 270/37, 52.18, 58.08; 412/33

(56) References Cited

U.S. PATENT DOCUMENTS

| | | | | |
|---|---|---|---|---|
| 3,383,852 A | | 10/1964 | Helmlicher et al. | 59/76 |
| 4,204,626 A | * | 5/1980 | Kutzner et al. | 227/81 |
| 4,315,588 A | * | 2/1982 | Faltin | 227/81 |
| 4,792,077 A | * | 12/1988 | Faltin | 227/81 |
| 4,850,520 A | | 7/1989 | Schumann et al. | 227/81 |
| 5,172,897 A | * | 12/1992 | Hansch et al. | 270/52.18 |
| 5,174,557 A | * | 12/1992 | Meier | 270/38 |
| 5,342,032 A | * | 8/1994 | Meier | 270/37 |
| 5,356,125 A | * | 10/1994 | Hansch et al. | 270/52.18 |
| 5,464,199 A | | 11/1995 | Stauber | 270/53 |
| 5,590,828 A | * | 1/1997 | Stauber | 227/81 |
| 5,690,265 A | | 11/1997 | Jakob | 227/81 |
| 6,223,964 B1 | | 5/2001 | Mueller | 227/81 |

FOREIGN PATENT DOCUMENTS

| | | |
|---|---|---|
| DE | 1452995 | 6/1969 |
| DE | 1761408 | 5/1972 |
| DE | 3810142 | 11/1988 |
| GB | 1223840 | 3/1971 |

* cited by examiner

*Primary Examiner*—Scott A. Smith
*Assistant Examiner*—Nathaniel Chukwurah
(74) *Attorney, Agent, or Firm*—Davidson, Davidson & Kappel, LLC

(57) ABSTRACT

A rotary stitching device has a wire supply, a cutting device for cutting a wire section from the wire supply, and a rotating forming wheel having a forming wheel axis of rotation, the rotating forming wheel receiving the wire section. A rotating delivery wheel has a delivery wheel axis of rotation parallel to the forming wheel axis of rotation and an outer circumference, the delivery wheel having an opening in the outer circumference and having at least one stitching head, and the forming wheel placing the wire section in the opening to form a stitch. A printed product conveyor moves printed products in a direction perpendicular to the delivery wheel axis of rotation so that the printed products receive the stitch from the stitching head.

11 Claims, 5 Drawing Sheets

ROTARY STITCHING DEVICE

BACKGROUND OF THE INVENTION

The present invention relates generally to binderies for printed materials and more particularly to finishing units for stitching printed products, which for example move on a saddle-back conveying device.

U.S. Pat. No. 6,223,964 discloses a device for longitudinally stitching multipiece printed products. A rotating stitcher drives U-shaped wire stitches into printed products being conveyed along a linear path. A stapling closing device cooperates with the rotating stitcher to close the wire stitches.

The wire stitches used by the rotating stitcher are created from a wire being fed directly to the stitcher, the wire being cut by a wire cutter cutting off sections of the wire. The straight sections are fed to the stitcher at stitching heads of the stitcher. A wire bending link arranged at the stitcher then bends the wire sections to create the U-shaped wire stitches that are driven into the printed products. U.S. Pat. No. 6,223,964 is hereby incorporated by reference herein.

U.S. Pat. No. 5,464,199 discloses a gathering stapler for printed products. A plurality of gathering sections extends parallel to one another and circulates transversely. A stapling apparatus has stapling heads that meet up with the gathering sections. The stapling heads run past a wire cut-off dispenser, from which a wire section is obtained. The wire section may be magnetically held until a stapling head runs into a fixed-in-place wire bending link to form a staple, which is then applied to the printed product.

U.S. Pat. No. 5,690,265 discloses a stapling device including a supply roll with a conveying unit for the stapling material, a cutting device for cutting the stapling material to a length required for forming the staples, a staple forming unit, a plunger for pushing the staples into the printed product and a staple closing unit.

BRIEF SUMMARY OF THE INVENTION

An object of the present invention is to provide a rotary stitching device with improved stitch creation.

The present invention provides a rotary stitching device comprising:

- a wire supply;
- a cutting device for cutting a wire section from the wire supply;
- a rotating forming wheel having a forming wheel axis of rotation, the rotating forming wheel receiving the wire section;
- a rotating delivery wheel having a delivery wheel axis of rotation parallel to the forming wheel axis of rotation and an outer circumference, the delivery wheel having an opening in the outer circumference and having at least one stitching head, the forming wheel placing the wire section in the opening to form a stitch; and
- a printed product conveyor for moving printed products in a direction perpendicular to the delivery wheel axis of rotation, the printed products receiving the stitch from the stitching head.

By having a rotating forming wheel cooperating with the delivery wheel, lower inertias and higher speeds may be obtained. Fewer parts are required, and wire formation can be improved.

Preferably, the cutting device is attached to the rotating forming wheel, and reciprocates as the forming wheel rotates. The rotating forming wheel preferably has a reciprocating pusher for moving the wire section toward the opening of the delivery wheel. The stitch preferably transferred to the opening by pressurized air.

The forming wheel preferably has a forming cell with walls for forming the stitch from the wire section, the pusher entering the forming cell. Alternately, the forming wheel could be the opening of the delivery wheel, with the reciprocating pusher entering the opening.

The forming wheel preferably has a plurality of cutting devices spaced evenly about an outer circumference and the delivery wheel preferably has a plurality of stitching heads spaced evenly about its outer circumference.

The stitching head is preferably located in the opening, and may be a reciprocating pusher for pushing the stitch into the printed product.

A rotating clincher wheel is located on the other side of the printed product from the delivery wheel to clinch the stitch.

BRIEF DESCRIPTION OF THE DRAWINGS

A preferred embodiment of the present invention is described below by reference to the following drawings, in which.

DETAILED DESCRIPTION OF A PREFERRED EMBODIMENT

Figure 1:
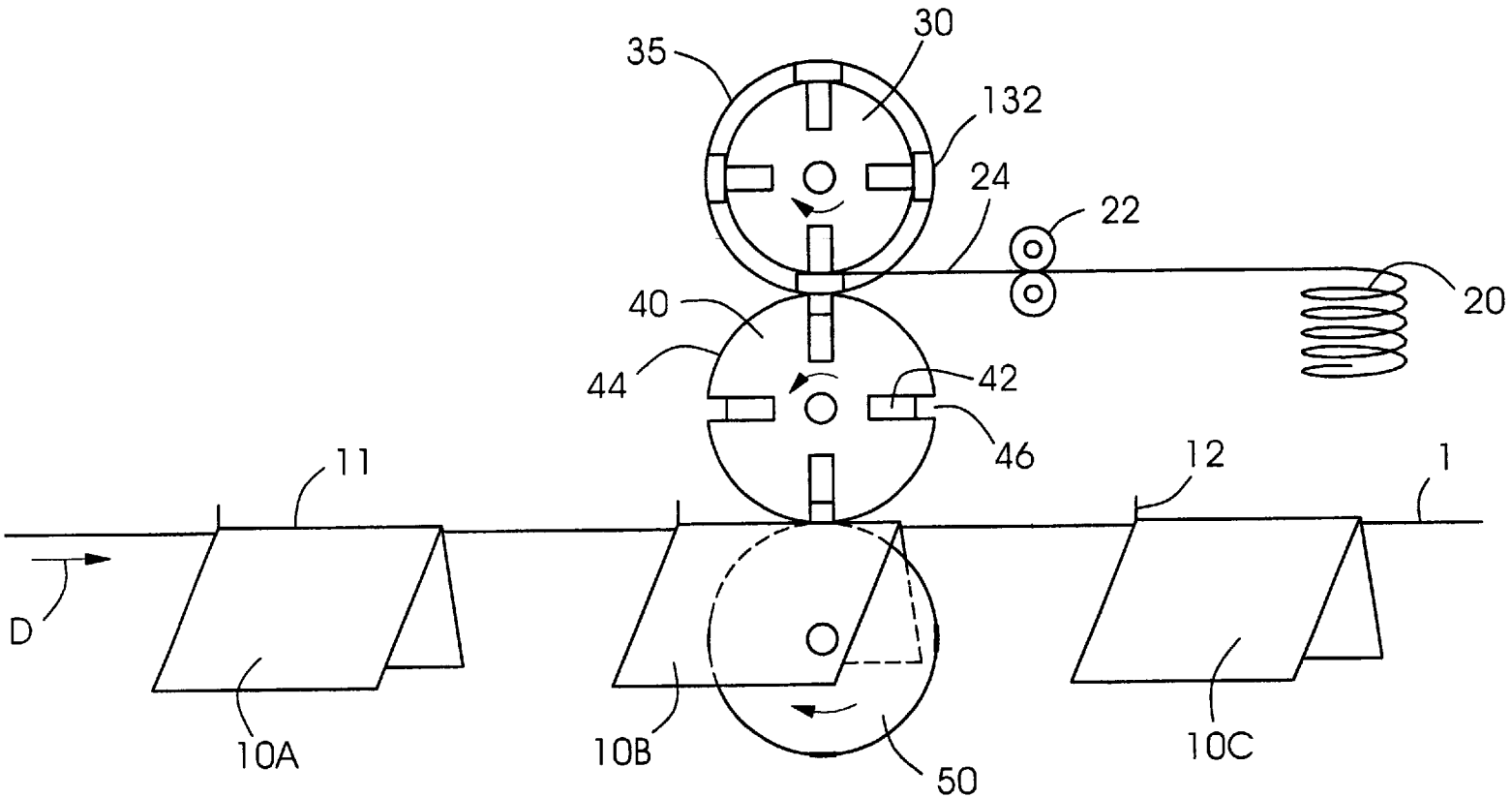
FIG. 1 shows a schematic view of the stitching device according to the present invention.

FIG. 1 shows device for stitching a printed product. A saddle-back conveyor 1 with end stops 12 moves a plurality printed products 10A, 10B, 10C in a direction D. Spines 11 of the printed products thus are presented to the stitching device.

A wire supply 20, on for example a spool, feeds out wire 24 through the action of driven wire transfer rollers 22, which thus control the speed of the wire delivery to a rotating forming wheel 30. A plurality of cutting and forming devices 132 for cutting the wire 24 are spaced evenly around the circumference 35 of the forming wheel 30.

A rotating delivery wheel 40 has an outer circumference 44, and a plurality of stitching heads 42 and openings 46 spaced evenly about circumference 44.

The axis of rotation of the delivery wheel 40 is parallel to the axis of rotation of the forming wheel 30.

At a side of the printed products 10A, 10B, 10C opposite the delivery wheel 40 is a rotating clincher wheel 50 for clinching a stitch delivered to the printed product 10B by the delivery wheel 40. Conveyor 1 includes a cutout or two parallel chains, so that the clincher wheel can contact the inner side of spine 11 at the cutout or between the two parallel chains.

Figure 2:
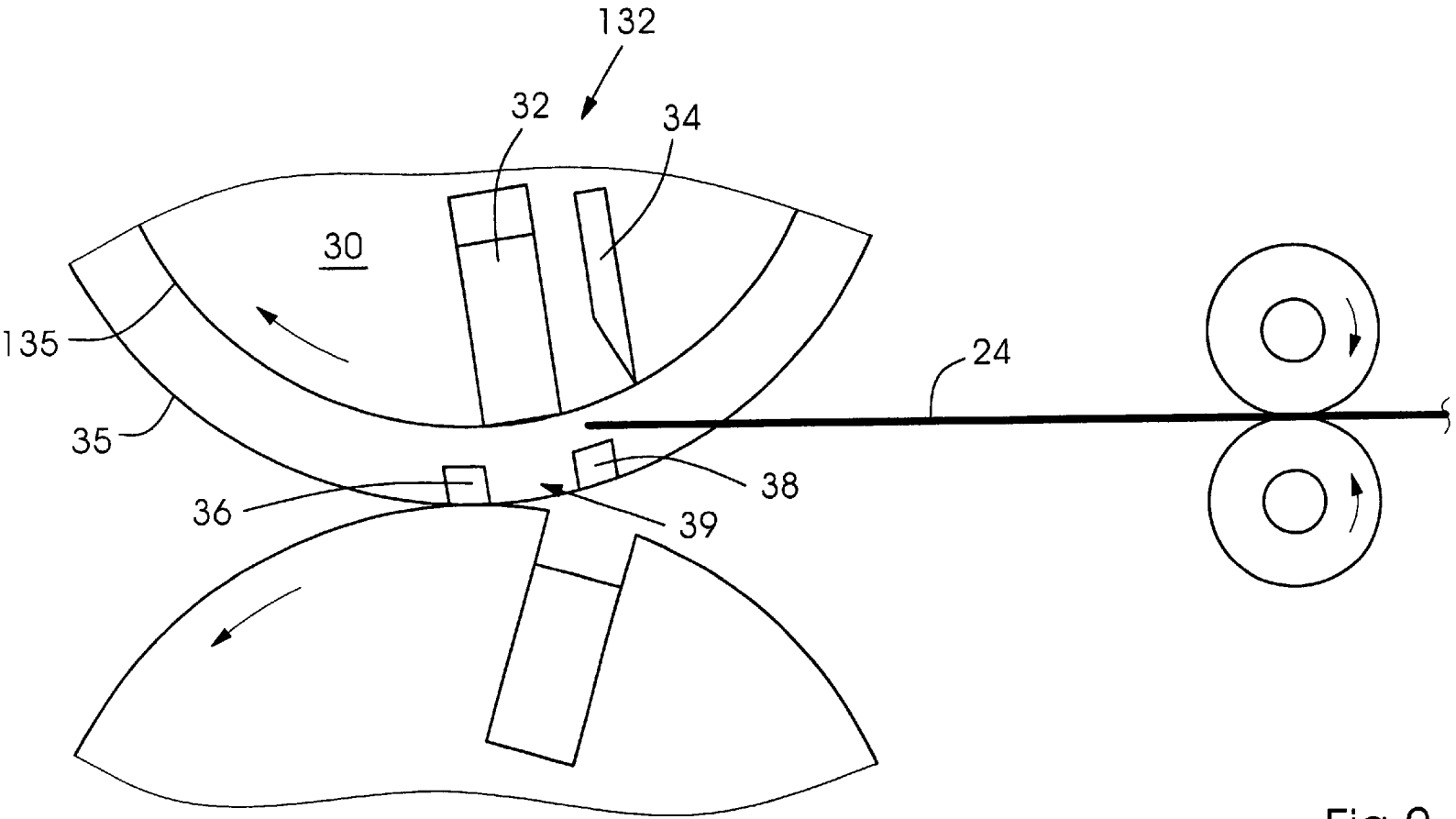
FIG. 2 shows details of the wire entering the forming wheel.

FIG. 2 shows details of the wire 24 entering the forming wheel 30. A cutout in outer circumference 35 at least in the area of cutting and forming device 132 permits wire 24 to enter the cutting and forming device 132 between an inner circumference 135 of the cutout and two bars 36, 38. Bars 36, 38 extend axially in the cutout so as to form a forming cell 39, which opens toward the delivery wheel 40.

Cutting and forming device 132 includes a reciprocating pusher 32 and a reciprocating knife 34.

Figure 3:
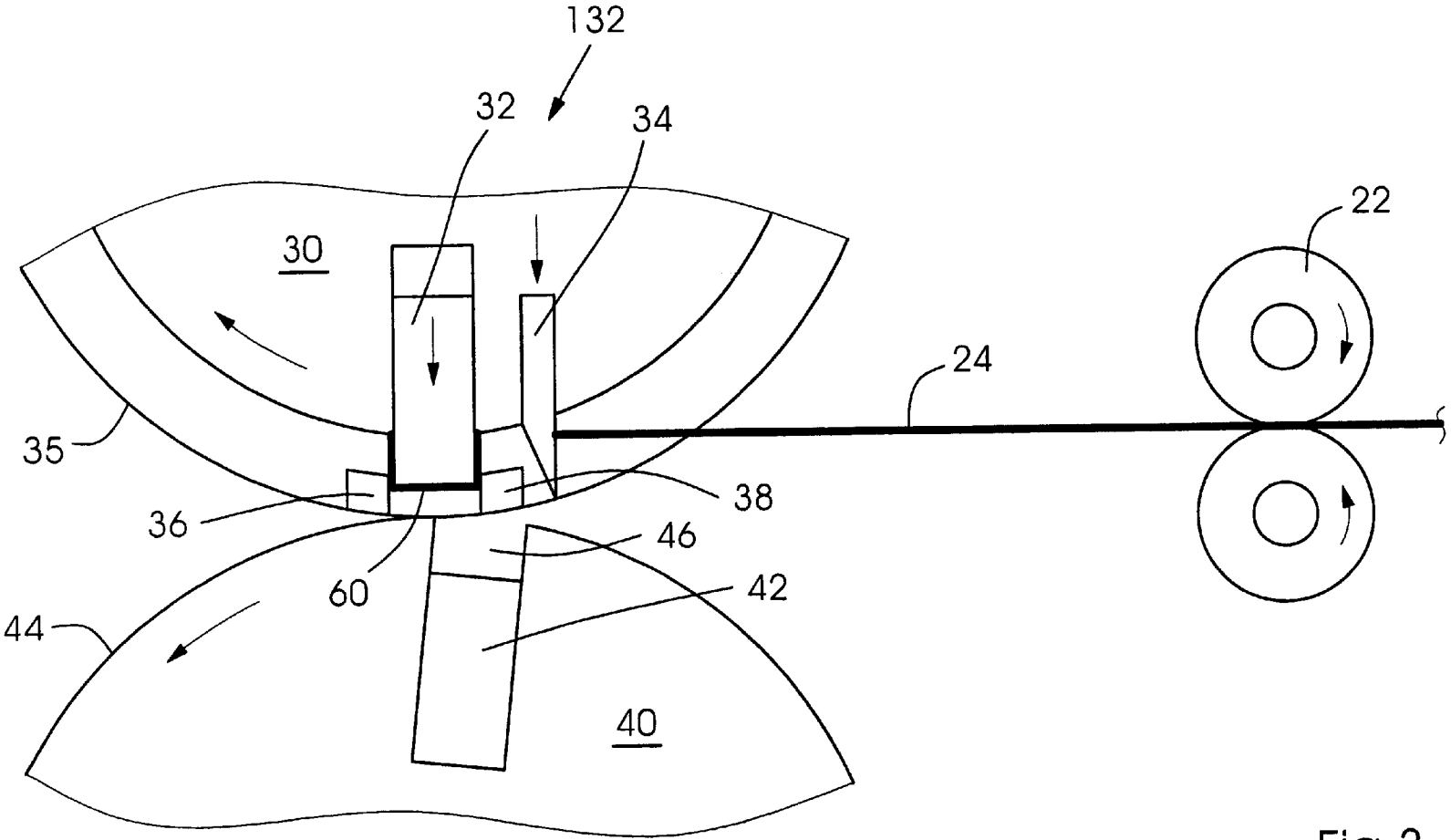
FIG. 3 shows details of the interaction between the forming wheel and the delivery wheel.

FIG. 3 shows details of the interaction between the forming wheel 30 and the delivery wheel 40. As wire 24 fully enters cutting and forming device 132, reciprocating knife 34 cuts wire 24 to form a wire section 60. Pusher 32 begins moving toward delivery wheel 40, and pushes wire section 60 past forming bars 36, 38 of the forming cell to create bends in the wire section and to form a stitch.

Figure 4:
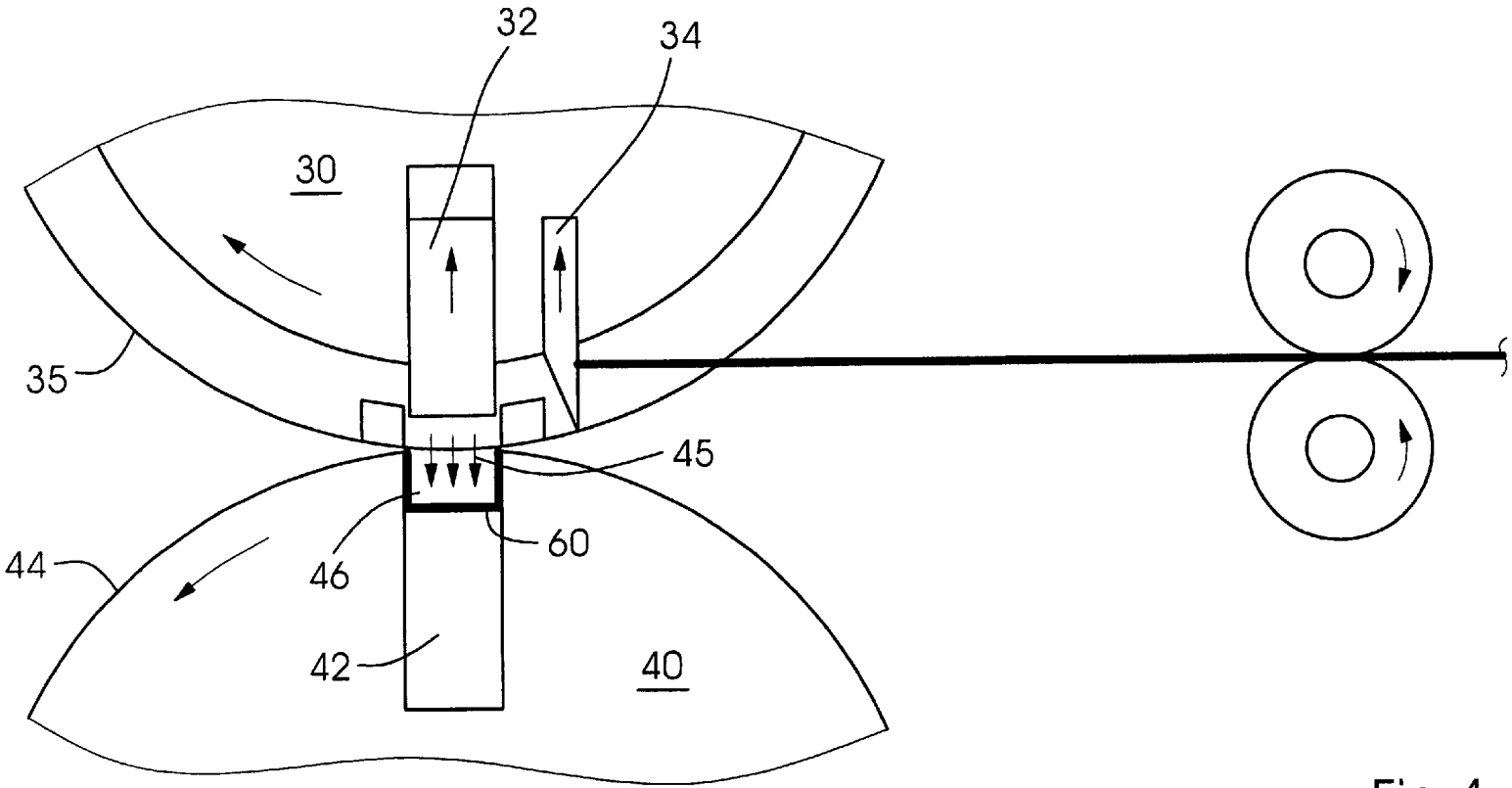
FIG. 4 shows the delivery wheel accepting the stitch from the forming wheel.

FIG. 4 shows delivery wheel 40 accepting the stitch 60 from forming wheel 30. Stitch 60 fits into opening 46 of the delivery wheel 40. Pressurized air 45 can be provided through holes in the end of pusher 32 to move the stitch 60 into the opening 46. Stitch 60 thus sits in opening 46, and may be held there, for example by friction or magnets. Opening 46 is directly above stitching head 42, which may be formed easily by a reciprocating pusher.

Figure 5:
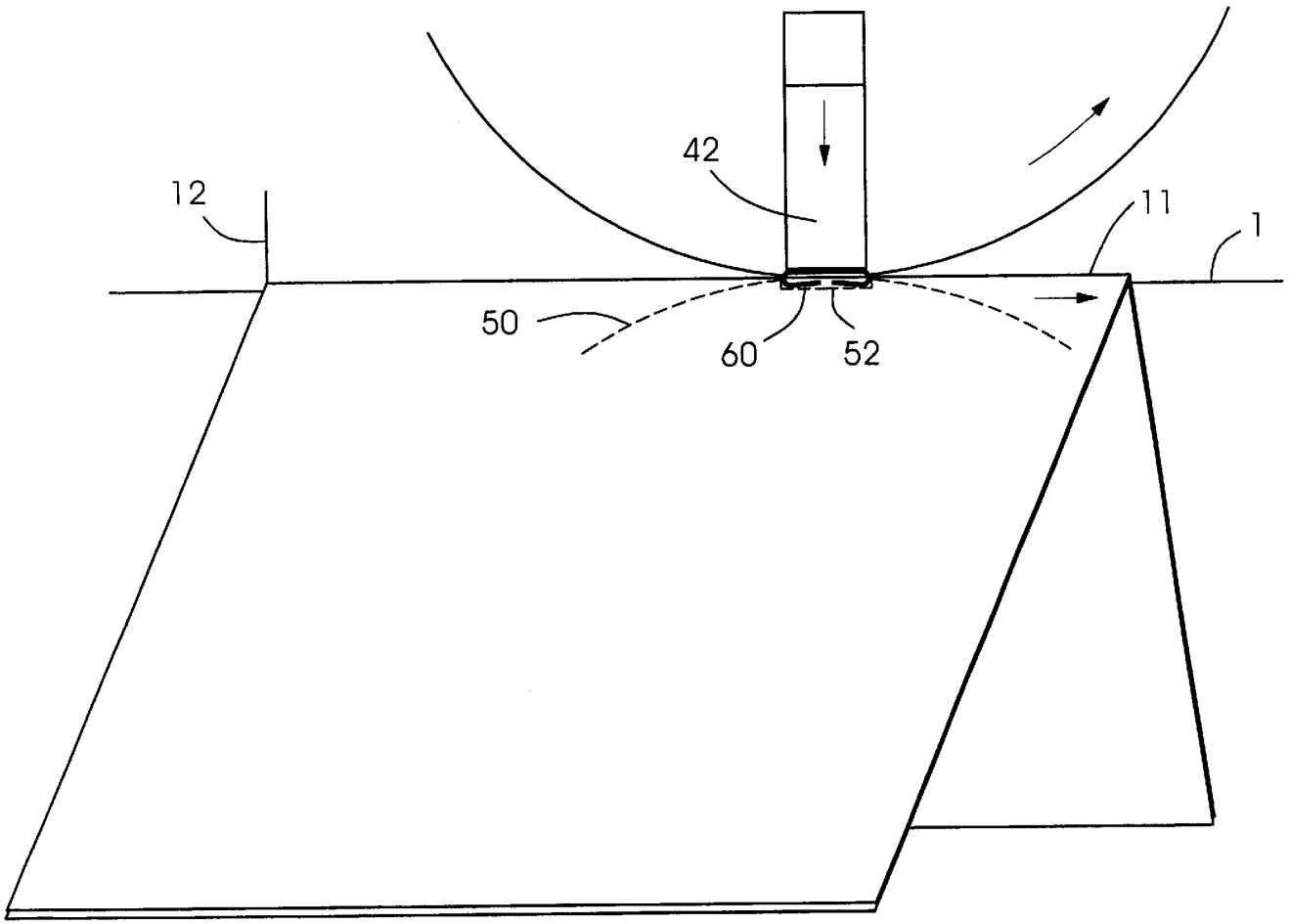
FIG. 5 shows the stitch being applied to a printed product.

FIG. 5 shows the stitch 60 being applied to spine 11 of printed product 10B. Reciprocating stitching head 42 forces stitch 60 through the spine 11. Clincher wheel 50 has a plurality of clinch openings 52 spaced evenly about its circumference to interact with the stitching heads 42 and clinch stitch 60 about the spine 11 to bind the printed product 10B.

All three wheels 30, 40, 50 are driven by servo motor or a variable mechanism device, such as gearing. The peripheral speed of delivery wheel 40 is synchronized to the speed of the conveyor 1. The forming wheel 30 is synchronized to the delivery wheel 40, and the speed of the wire delivery is set by the rollers 22.

A compressed air supply can be provided to provide the pressurized air 45.

What is claimed is:

1. A rotary stitching device comprising:

a wire supply;

a cutting device for cutting a wire section from the wire supply;

a rotating forming wheel having a forming wheel axis of rotation, the rotating forming wheel receiving the wire section;

a rotating delivery wheel having a delivery wheel axis of rotation parallel to the forming wheel axis of rotation and an outer circumference, the delivery wheel having an opening in the outer circumference and having at least one stitching head, the forming wheel placing the wire section in the opening to form a stitch; and a printed product conveyor for moving printed products in a direction perpendicular to the delivery wheel axis of rotation, the printed products receiving the stitch from the stitching head.

2. The rotary stitching device as recited in claim 1 wherein the cutting device is attached to the rotating forming wheel, the cutting device reciprocating as the forming wheel rotates.

3. The rotary stitching device as recited in claim 1 wherein the rotating forming wheel includes a reciprocating pusher for moving the wire section toward the opening of the delivery wheel.

4. The rotary stitching device as recited in claim 3 wherein the pusher delivers pressurized air to the wire section.

5. The rotary stitching device as recited in claim 3 wherein the forming wheel has a forming cell with walls for forming the stitch from the wire section, the pusher entering the forming cell.

6. The rotary stitching device as recited in claim 1 further comprising at least one further cutting device.

7. The rotary stitching device as recited in claim 1 wherein the cutting device and the at least one further cutting device are attached to the forming wheel and spaced evenly about a circumference of the forming wheel.

8. The rotary stitching device as recited in claim 1 wherein the delivery wheel further includes at least one further stitching head, the stitching head and the at least one further stitching head being spaced evenly about the outer circumference.

9. The rotary stitching device as recited in claim 1 wherein the stitching head is located at the opening.

10. The rotary stitching device as recited in claim 9 wherein the stitching head is a reciprocating pusher for pushing the stitch into the printed product.

11. The rotary stitching device as recited in claim 1 further comprising a rotating clincher wheel located on a side of the printed product opposite the delivery wheel.

* * * * *